US005804796A

United States Patent [19]

Kanesaka

[11] Patent Number: 5,804,796

[45] Date of Patent: Sep. 8, 1998

[54] IGNITION SYSTEM WITH RESISTANCE VALUE DIFFERENCE FIRE EXTINCTION DETECTION CIRCUIT

[76] Inventor: Ichiro Kanesaka, 7-3-1-1014, Hikarigaoka, Nerima-ku, Tokyo, Japan

[21] Appl. No.: 603,241

[22] Filed: Feb. 20, 1996

[51] Int. Cl.[6] ..... F23Q 7/12; F23N 5/00

[52] U.S. Cl. ..... 219/263; 219/269; 431/66; 431/255

[58] Field of Search ..... 219/262, 263, 219/260, 270, 269; 431/66–67, 73, 74, 80, 71, 72, 28, 43, 255, 258; 126/85 A, 92 B

[56] References Cited

U.S. PATENT DOCUMENTS

| | | | |
|---|---|---|---|
| 4,741,692 | 5/1988 | Sadakata et al. | 431/258 |
| 5,240,406 | 8/1993 | Kanesaka | 431/66 |

FOREIGN PATENT DOCUMENTS

| | | |
|---|---|---|
| 59-63420 | 4/1984 | Japan . |
| 61-83825 | 4/1986 | Japan . |
| 1-263416 | 10/1989 | Japan . |
| 1-272078 | 10/1989 | Japan . |
| 8-166130 | 6/1996 | Japan . |

*Primary Examiner*—John A. Jeffery
*Attorney, Agent, or Firm*—Rabin, Champagne & Lynt, P.C.

[57] ABSTRACT

In an ignition system for sensing a change in a resistance value during a combustion of a heating resistive element and detecting a fire extinction, a resistance value of the heating resistive element is sensed by a resistance value detecting circuit at a predetermined time interval set by an interval setting circuit, and a difference between the resistance value and that sensed before an elapse of the predetermined period of time is calculated by a resistance value calculating circuit. A comparing circuit compares a difference in the resistance values with a reference value stored in a reference value memory, and a extinction detecting circuit detects a fire extinction when the difference calculated by the resistance value difference calculating circuit had exceeded the reference value. Accordingly, there is attained an ignition system which reasonably determines a fire extinction without an additional complex structure.

2 Claims, 4 Drawing Sheets

IGNITION SYSTEM WITH RESISTANCE VALUE DIFFERENCE FIRE EXTINCTION DETECTION CIRCUIT

BACKGROUND OF THE INVENTION

The present invention relates to an ignition system employing a heating resistive element such as a nichrome wire, a kanthal wire, a platinum and a silicon carbide, for example, to an ignition system including a support body made of a ceramic material and a resistive element formed thereof, for accomplishing an ignition such as a gas ignition by supplying power to the resistive element.

DESCRIPTION OF THE RELATED ART

In the prior art, there is known a gas heater of which ignition of gas is accomplished by supplying power to a resistive element. As the igniting means, for example, there is known a ceramic ignition heater including a support body made of a ceramic material and a heating resistive element formed thereof, for accomplishig ignition of gas by supplying power to the heating resistive element. In a case where a fire of the gas is extinguished for some reasons after the ignition of gas is achieved by the ceramic ignition heater, it is needed to detect the condition of the fire extinction as soon as possible to interrupt the gas supply for safety. Conventionally, a flame sensor has been adopted as means for detecting the fire extinction.

However, in the gas heater of the prior art, the igniting means and the extinction sensing means are separately disposed, which leads to a problem of an increased number of members disposed in the fire. In order to solve this problem, the applicant has proposed in U.S. Pat. No. 5,240,406 a gas heater provided with a ceramic ignition heater which ignits gas, thereby sensing a fire extinction based on a change in a resistance value of the ceramic ignition heater.

In the described prior art, in a case where ignition or sensing of the fire extinction is achieved by sensing the resistance value of the ceramic ignition heater, the resistance value is measured constantly, and the fire extinction is sensed when the measured value had gone below the predetermined value. However, in a case where the fire extinction is determined by the resistance value, the resistance value varies depending on a material used for the ceramic ignition heater. Therefore, a fire extinction is not effectively detected with a fixed resistance value, which leads to a problem that there is needed a complex structure to compensate the resistance value.

The present invention has been achieved with such points in mind.

SUMMARY OF THE INVENTION

It therefore is an object of the present invention to provide a ceramic ignition heater capable of properly sensing a fire extinction without a complex adjustment to compensate a deviation of a resistance value of a ceramic ignition heater.

In accordance with the present invention, there is provided an ignition system comprising a heating resistive element, an interval setting means for setting a predetermined time interval, a resistance value detecting means for sensing a resistance value of the heating resistive element disposed in a fire at a predetermined time interval set by the interval setting means, a memory means for storing a resistance value of the heating resistive element sensed by the resistance value detecting means, a resistance value calcutating means for calculating a difference between the resistance value of the heating resistive element sensed by the resistance value detecting means and a resistance value sensed before an elapse of the predetermined period of time stored in the memory means, a comparing means for comparing the resistance value difference of the heating resistive element sensed at the predetermined time interval with a predetermined threshold value, and an extinction detecting means for sensing a fire extinction according to a result obtain from the comparing means.

BRIEF DESCRIPTION OF THE DRAWINGS

The objects, features and advantages of the present invention will become more apparent from the consideration of the following detailed description, taken in conjunction with the accompanying drawings, in which.

DESCRIPTION OF THE PREFERRED EMBODIMENTS

Figure 1:
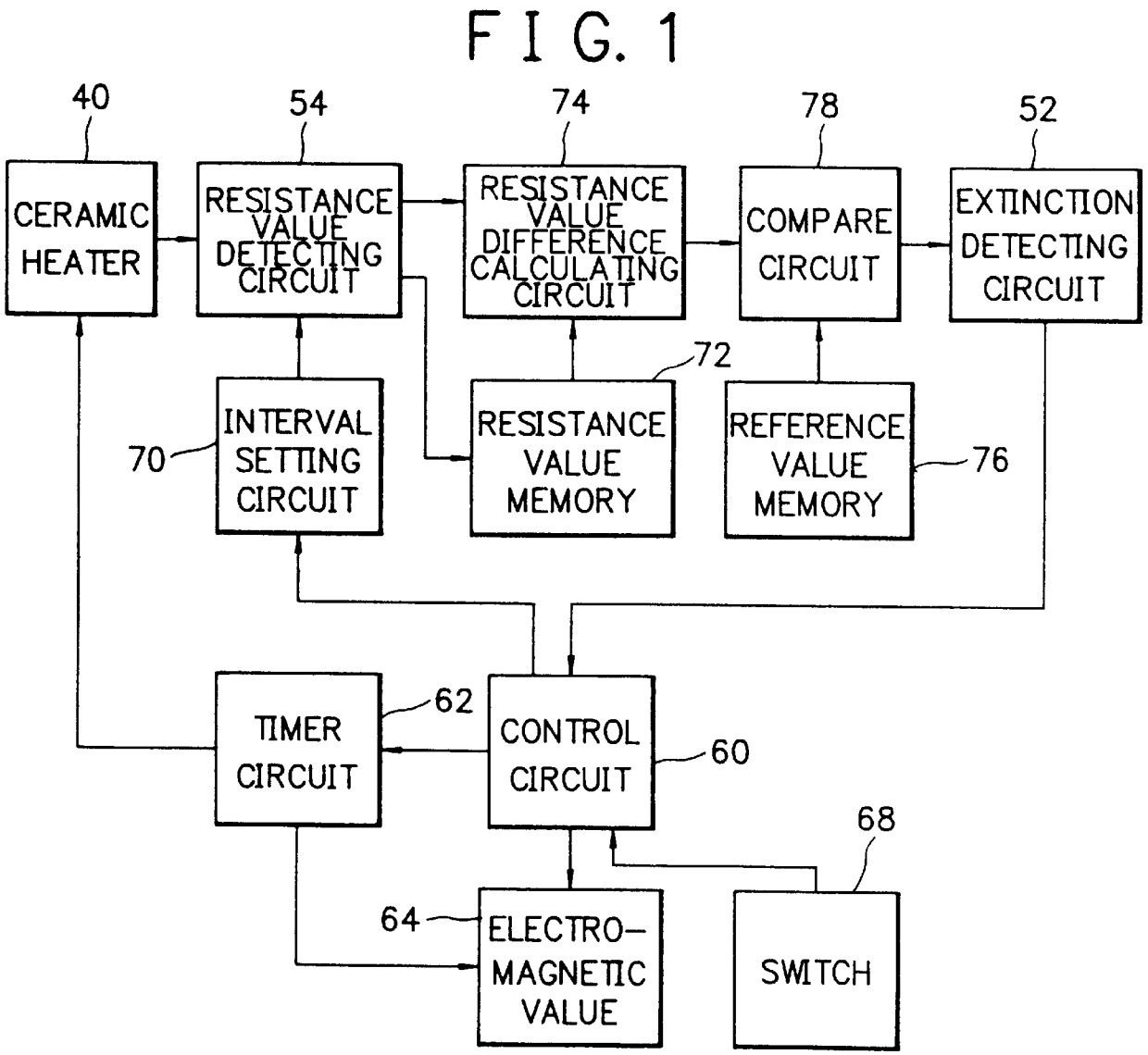
FIG. 1 is a block diagram showing an ignition system applied to a ceramic ignition heater according to an embodiment of the present invention.

Referring now to the drawings, a description will be given in detail of an ignition system in accordance with the present invention.

FIG. 1 is a block diagram showing an ignition system applied to a ceramic ignition heater according to an embodiment of the invention. Although a ceramic ignition heater 40 is used in the present embodiment, other heating resistive element may be used instead of the ceramic ignition heater 40. As other heating resistive element, effectively used is a base metal heating element such as a nichrome wire and a kanthal wire, a platinum heating element employing a platinum wire, and a silicon carbide heating element.

Figure 2:
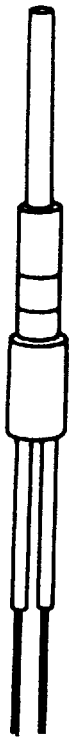
FIG. 2 is a front view showing a ceramic ignition heater employed in the ignition system of FIG. 1.
Figure 3:
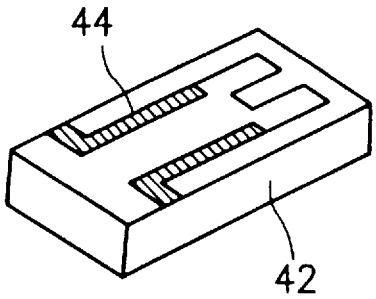
FIG. 3 is a perspective view showing a process of manufacturing the ceramic ignition heater of FIG. 2.
Figure 4:
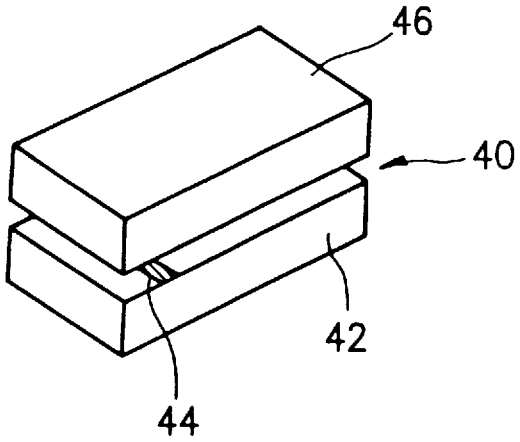
FIG. 4 is a perspective view showing a process of manufacturing the ceramic ignition heater of FIG. 2.
Figure 5:
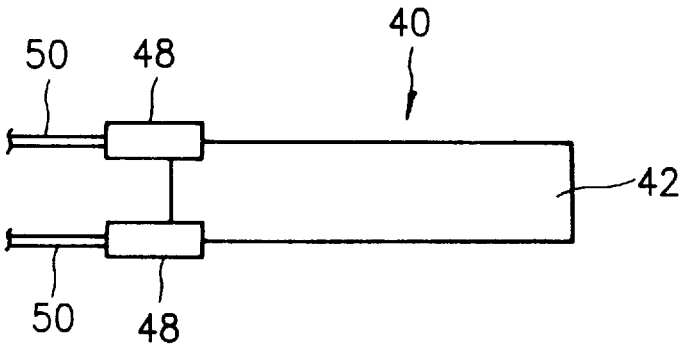
FIG. 5 is a schematic diagram showing the constitution of the ceramic ignition heater of FIG. 2.

A ceramic ignition heater 40 has a contour of FIGS. 2 to 4. A resistive element 44 is printed on a ceramic base 42 formed with a silicon nitride $Si_3N_4$ so as to be sintered together with another ceramic plate 46 as shown in FIG. 4. After metalizing the sintered items, as shown in FIG. 5, power supply wires 50 are connected via metal members 48 to the resistive element 44.

As shown in FIG. 1, the ceramic ignition heater 40 is connected to a timer circuit 62. A control of power supplied to the ceramic ignition heater 40 and an ignition of gas is achieved by the timer circuit 62. A resistance value detecting circuit 54 is connected to the ceramic ignition heater 40. The ceramic ignition heater 40 is heated, and gas is supplied and a power supplied to the ceramic ignition heater 40 is stopped after their respective predetermined periods of time had passed. Then, a resistance value of the ceramic ignition heater 40 is sensed. An interval setting circuit 70 is connected to the resistance value detecting circuit 54 to set a predetermined time interval, e.g. 30 seconds. The resistance value detecting circuit 54 senses a resistance value at the predetermined time interval set by the interval setting circuit 70. The resistance value sensed by the resistance value detecting circuit 54 is stored in a resistance value memory 72. The resistance value difference calculating circuit 74 calculates a difference between a resistance value sensed by the resistance value detecting circuit 54 and a resistance value sensed before an elapse of the predetermined period of time.

A compare circuit 78 is connected to the resistance value difference calculating circuit 74. The compare circuit 78 compares the difference in the resistance values calculated by the resistance value difference calculating circuit 74 with a reference value of a resistance value difference which is stored in the reference value memory 76. A reference value for the resistance value difference to determine a fire extinction is stored in the reference value memory 76. For example, the reference value may be set to 10 ohms. An extinction detecting circuit 52 is connected to the compare circuit 78 to determine the fire extinction according to the result sent from the compare circuit 78. Although not shown, it is preferable to have an input means to input settings such as the predetermined time interval and the reference resistance value difference.

A control circuit 60, a circuit for controlling the whole operation, is connected to the extinction detecting circuit 52, the timer circuit 62, and a switch 68.

In the circuit section connected as above, as the ceramic ignition heater 40 has strength against heat, it is used as an igniting device, and moreover, the heater 40 is used as a sensor for sensing extinction of the gas fire. The ceramic ignition heater 40 is powered by the timer circuit 62, and when a predetermined period of time is elapsed, the body thereof is heated to a high temperature. Thereafter, fuel gas is supplied to be ignited. The resistance value of the ceramic ignition heater 40 varies with a change in the temperature thereof.

The resistance value detecting circuit 54 is a circuit for sensing the resistance value of the ceramic ignition heater 40. As the resistance value of the ceramic ignition heater 40 sensed by the resistance value detecting circuit 54 varies depending on the temperature thereof, a detection of the fire extinction is determined by checking whether a difference between the resistance values obtained at the predetermined time intervals had exceeded a predetermined threshold value. Instead of comparing the difference in the resistance values with the threshold value, a percentage of the resistance value reduced may be compared with the predetermined threshold value, e.g. 5%.

The extinction detecting circuit 52 senses a fire extinction according to the result from the compare circuit 78. Typically, when the gas is ignited, a resistance value of the ceramic ignition heater at 300 to 500° C. is sensed. However, when the fire goes out, the temperature starts to fall and the sensed resistance value also decreases, which enables a detection of a fire extinction. For example, a fire extinction is detected when the temperature had fallen to around 100° C. However, in the present invention, as a reference resistance value difference, for example, a value of 10 ohms is stored in the reference value memory 76. In this case, a fire extinction is detected when a difference between the resistance values sensed at a predetermined period of time, i.e. a time interval of 30 seconds, exceeds 10 ohms.

The control circuit 60, advantageously configured with a microprocessor, controls various sections of the system in response to such signals to be used for decision of the fire extinction as an input from the switch 68 and a signal from the extinction detecting circuit 52. The timer circuit 62 includes a timer for measuring a predetermined period of time. The circuit 62 measures a lapse of time for a control operation to supply power to the ceramic ignition heater 40 and to open/close the electromagnetic valve 64.

The electromagnetic valve 64 is disposed on a nozzle pipe not shown to control the volume of gas supplied to the gas burner. The switch 68 is a switch for the operator to input ignition instruction.

When the operator inputs an ignition instruction from the switch 68, the instruction is sent to the control circuit 60, which then outputs a control signal to the timer circuit 62. The ceramic ignition heater 40 is powered and heated by the timer circuit 62. When the operation to power the ceramic ignition heater 40 is started, a control signal is delivered from the control circuit 60 to the timer circuit 62. The timer 62 initiates measuring a predetermined period of time. When the predetermined period of time, for example, a period of ten seconds has elapsed, the ceramic ignition heater 40 is heated to a gas ignition temperature, for example, 1200° C. As a result of the measurement, when the timer circuit 62 notifies that the condition of the elapse of ten seconds, the control circuit 60 opens the electromagnetic valve 64 to feed gas to the burner. Accordingly, gas is ignited so as to start the combustion thereof.

After the electromagnetic valve 64 is opened to start burning the supplied gas, a control signal is outputted from the control circuit 60 to the timer circuit 62, which starts measuring a predetermined time in response thereto. When the predetermined period of time e.g. a period of ten seconds is elapsed i.e. when the timer 62 notifies the condition, the timer 62 stops the power supplied to the ceramic ignition heater 40. The power supplied to the ceramic ignition heater 40 is thus interrupted when the predetermined period of time is elapsed after the ignition, which prevents the ceramic ignition heater 40 from being deteriorated.

After the ignition, while an ordinary fuel combustion is taking place, the fire directly heats the ceramic ignition heater 40. Consequently, the ceramic ignition heater 40 is kept retained at at high temperature. However, when the fire is extinguished for some reasons, for example, by an air blow or wind, the ceramic ignition heater 40 is not heated and hence the temperature thereof starts to fall at once. As described above, after the ignition, a resistance value of the ceramic ignition heater 40 is sensed at a predetermined time interval, e.g. 30 seconds. A difference between a resistance value and that sensed 30 seconds before is compared with a predetermined threshold value, e.g. 10 ohms. If the difference in the values is more than 10 ohms, there is a determination of a fire extinction due to a sudden decrease of the resistance value.

When the fire extinction is detected by the extinction detecting circuit 52, the control circuit 60 closes the electromagnetic valve 64 depending on a signal from the extinction detecting circuit 52. Resultantly, the gas supply is stopped immediately and a control signal is outputted to the timer 62. Thereafter, power is again supplied to the ceramic ignition heater 40, thereby heating the ceramic ignition heater 40. As above, when a period of time, for example, a period of ten seconds is elapsed after the power is started to be supplied to the ceramic ignition heater 40, the temperature of the ceramic ignition heater 40 reaches the ignition temperature, for example, 1200° C. Consequently, the electromagnetic valve 64 is opened to supply gas again.

In a gas heater, there are levels to be selected in combustion, e.g. 3 levels, which are high fire, middle fire, and low fire. Therefore, a difference in resistance values at a predetermined time interval may exceed a threshold value when the level is switched from middle to low. Especially, when switching from high to low, a difference in resistance values may show a difference similar to that in the fire extinction. Therefore, when there is a switching, the extinction detecting circuit 52 may determine a fire extinction according to the resistance value difference. However, as the combustion level is switched by the operator in this case, the operator just needs to input an instruction for not executing a fire extinction detection at the switching operation.

As above, according to the ignition system of the present embodiment, the ceramic ignition heater 40 is used both as an igniting means and a fire extinction detecting means. In this constitution, a difference in resistance values of the ceramic ignition heater 40 is calculated at predetermined time intervals to determine a fire extinction. Thus, as in the case where a fire extinction is determined by sensing a resistance value constantly, there is no need to compensate a resistance value in consideration of a deviation of a resistance value of the ceramic ignition heater, and as a result, a fire extinction is properly determined. Therefore, a fire extinction is easily and effectively detected without any additional complex structure.

While the present invention has been described in its preferred embodiment with reference to the accompanying drawings, it will be appreciated that various changes and modifications can be made by those skilled in the art without departing from the spirit and scope of the present invention. For example, a predetermined time interval and a reference threshold value are not to be limited to the above described values.

According to the ignition system of the present invention, the heating resistive element is used both as an igniting means and a fire extinction detecting means. In this constitution, a difference in resistance values of the ceramic ignition heater is calculated at predetermined time intervals to determine a fire extinction. Thus, as in the case where a fire extinction is determined by a resistance value, there is no need to compensate a resistance value in consideration of a deviation of a resistance value of the heating resistive element, and as a result, a fire extinction is properly determined. Therefore, a fire extinction is easily and effectively detected without any additional complex structure.

What is claimed is:

1. An ignition system comprising:

a heating resistive element used for an ignition;

an interval setting means for setting a predetermined time interval;

a resistance value detecting means for sensing a resistance value of the heating resistive element disposed in a fire at a predetermined time interval set by the interval setting means;

a memory means for storing a resistance value of the heating resistive element sensed by the resistance value detecting means;

a resistance value calculating means for calculating a difference between the resistance value of the heating resistive element sensed by the resistance value detecting means and a resistance value sensed before an elapse of the predetermined period of time stored in the memory means;

a comparing means for comparing the resistance value difference of the heating resistive element sensed at the predetermined time interval with a predetermined threshold value; and an extinction detecting means for sensing a fire extinction according to a result obtained from the comparing means.

2. An ignition system according to claim 1, wherein the heating resistive element is a ceramic ignition heater.

* * * * *